United States Patent [19]

Roccaforte

[11] Patent Number: 4,621,736

[45] Date of Patent: Nov. 11, 1986

[54] RECLOSEABLE CARTON

[75] Inventor: Harry I. Roccaforte, Western Springs, Ill.

[73] Assignee: Waldorf Corporation, St. Paul, Minn.

[21] Appl. No.: 743,023

[22] Filed: Jun. 10, 1985

Related U.S. Application Data

[63] Continuation-in-part of Ser. No. 602,757, Apr. 23, 1984, abandoned.

[51] Int. Cl.[4] ..... B65D 5/54

[52] U.S. Cl. ..... 206/606; 206/609; 206/612; 206/616; 206/623

[58] Field of Search ..... 206/606, 623, 627, 609, 206/612, 616

[56] References Cited

U.S. PATENT DOCUMENTS

| | | | |
|---|---|---|---|
| 1,751,755 | 3/1930 | Paris | 206/627 |
| 2,251,283 | 8/1941 | Johnson | 206/623 |
| 2,608,341 | 8/1952 | Eckman | 206/612 |
| 3,773,248 | 11/1973 | Cecil et al. | 206/612 |

FOREIGN PATENT DOCUMENTS

| | | | |
|---|---|---|---|
| 453995 | 1/1949 | Canada | 206/623 |
| 672175 | 10/1963 | Canada | 206/612 |
| 369441 | 3/1932 | United Kingdom | 206/623 |

*Primary Examiner*—Stephen P. Garbe
*Attorney, Agent, or Firm*—Dorsey & Whitney

[57] ABSTRACT

A carton having side walls and end walls together with a top wall assembly and a bottom wall assembly. The carton is formed of an upper body portion and a lower body portion with the upper body portion severable and removable from the lower body portion. The severed upper body portion forms a closure cap which is applicable over the lower body portion to reclose the carton. Squeeze lines may also be provided to permit the lower body portion to be squeezed thereby facilitating the reapplication of the closure cap over the lower body portion.

11 Claims, 12 Drawing Figures

RECLOSEABLE CARTON

This application is a continuation-in-part of U.S. patent application Ser. No. 602,757 which was filed on Apr. 23, 1984 now abandoned.

BACKGROUND OF THE INVENTION

The present invention relates to a carton and more particularly to a carton which may be easily reclosed.

When a carton for certain products, such as food or similar articles, is opened, the contents of the carton are sometimes not fully consumed so that it is desirable to reclose the carton and store it for future use. There are many cartons in use which have recloseable features. Some such cartons are provided with a tongue-and-slot arrangement on the top wall assembly and are recloseable by inserting the tongue into the slot. One drawback to this type of recloseable carton is that often the tongue and/or slot is damaged when the carton is opened so that the recloseability of the carton is diminished or destroyed. Furthermore, in such recloseable cartons, the top wall is sometimes removed completely during the opening operation, thereby making recloseability of the carton impossible.

Another drawback of existing cartons is that as the contents of the carton are consumed and smaller amounts of the contents remain in the carton, storing of a full-sized almost empty carton wastes storage space.

Several cartons have been developed that provide a removable cap comprising the top wall of the carton and portions of the opposed side and end walls of the carton. This cap can be initially severed from the carton to provide access to the product stored therein. The cap later can be telescopingly slid over the remaining bottom portion of the carton. The prior art carton typically was constructed to facilitate this initial severance of the cap from the bottom of the carton. The prior art constructions have included perforation lines to facilitate this initial severance of the carton cap, as shown in U.S. Pat. No. 2,145,430 which issued to New on Jan. 31, 1939. Other prior art cartons have included arrays of interrupted cut lines in the carton wall to form tear strips in the paperboard material. A force could be exerted on the tear strip to severe the tear strip from the carton, thereby dividing the carton into a cap and a base. Still other prior art cartons of this general type have incorporated tear strings into the paperboard material to facilitate the initial opening of the carton.

Certain of the prior art cartons have included a plurality of generally parallel arrays of paperboard severance means disposed intermediate the top and bottom of the carton. This structure enables the carton to become progressively smaller as the material therein is used.

The prior art recloseable cartons of the general type described above also typically have included structures to facilitate the telescoping remounting of the carton cap onto the base after the initial opening of the carton. For example, U.S. Pat. No. 2,251,283 which issued to Johnson on Aug. 5, 1941 shows fold lines adjacent to each corner of the carton base to facilitate the effective pinching together of the carton base to define an area smaller than the cap. Canadian Pat. No. 453,995 which issued to Richardson on Jan. 11, 1949 shows a complicated array of fold lines formed in the opposed end panels of the carton base to again facilitate the pinching together of the carton bottom. Still another arrangement of score lines is shown in British Patent Specification No. 369,441 which issued to Hartman and is dated Mar. 24, 1932. U.S. Pat. No. 3,189,251 which issued to McFarland on June 15, 1965 shows a more complicated arrangement of overlapping panels to facilitate this telescoping mounting of the carton cap. The structure shown in U.S. Pat. No. 3,189,251 appears to utilize an excessive amount of paperboard material. A more recent reference showing foldlines at the corners of a recloseable carton is U.S. Pat. No. 4,474,324 which issued to Forbes Jr. on Oct. 2,1984.

The above described references either: (1) utilize excessive paper board material; (2) yield an undesirable or ineffective severence between the carton top and base; or (3) utilize a confusing and partly ineffective arrangement of foldlines to facilitate the telescoping mounting of the carton top on to the base.

BRIEF DESCRIPTION OF THE INVENTION

The present invention overcomes these drawbacks and has for one of its objects the provision of an improved carton which may be easily reclosed.

Another object of the present invention is the provision of an improved carton in which its recloseability is not destroyed when the carton is initially opened.

Another object of the present invention is the provision of an improved carton having means for easily opening the carton and for easily reclosing it.

Another object of the present invention is the provision of an improved carton in which the size of the carton may be reduced when only a small amount of contents remain in the carton.

Other and further objects of the invention will be obvious upon an understanding of the illustrative embodiment about to be described, or will be indicated in the appended claims, and various advantages not referred to herein will occur to one skilled in the art upon employment of the invention in practice.

These and other objects of the invention are accomplished by providing means in which the upper portion of the carton below the top wall assembly is severed from the lower portion to form a closure cap which is adapted to fit over the remaining lower portion of the carton to reclose the carton. Means may also be provided on the carton for removing additional sections of the lower portion of the carton so as to reduce the size of the carton when the remaining contents thereof are low.

The carton cap can be severed from the carton base by a tear strip and/or by a tear string in the paperboard material. Preferably the carton includes a pair of parallel spaced apart cut lines extending inwardly from the outer surface of the carton. The cut lines preferably are about onequarter inch apart and each extend to a depth of between approximately 20% and 50% of the thickness of the paperboard material from which the carton is formed. This preferred embodiment further includes a tear string affixed to the inwardly facing side of the carton and disposed intermediate the two cut lines. The tear string preferably is about onesixteenth inch wide.

The carton can further be provided with a pair of score line that intersect one another at the partial cut line closest to the bottom of the carton. These score line extend inwardly from the outer surface of the carton and intersect at a point approximately midway between the side panels thereof. This single pair of intersecting score lines has been found to sufficiently facilitate the telescoping mounting of the carton cap on the base without having any substantial structural effect on the carton. Furthermore, this particular alignment of score lines has been found to be easy for the consumers to understand and manipulate. This single pair of cut lines has been found to be particularly effective with the sevenance obtained with the above described arrangement of cut lines and tear string.

A preferred embodiment of the invetion has been chosen for purposes of illustration and description and is shown in the accompanying drawings forming a part of the specification, wherein.

DESCRIPTION OF THE INVENTION

Figure 1:
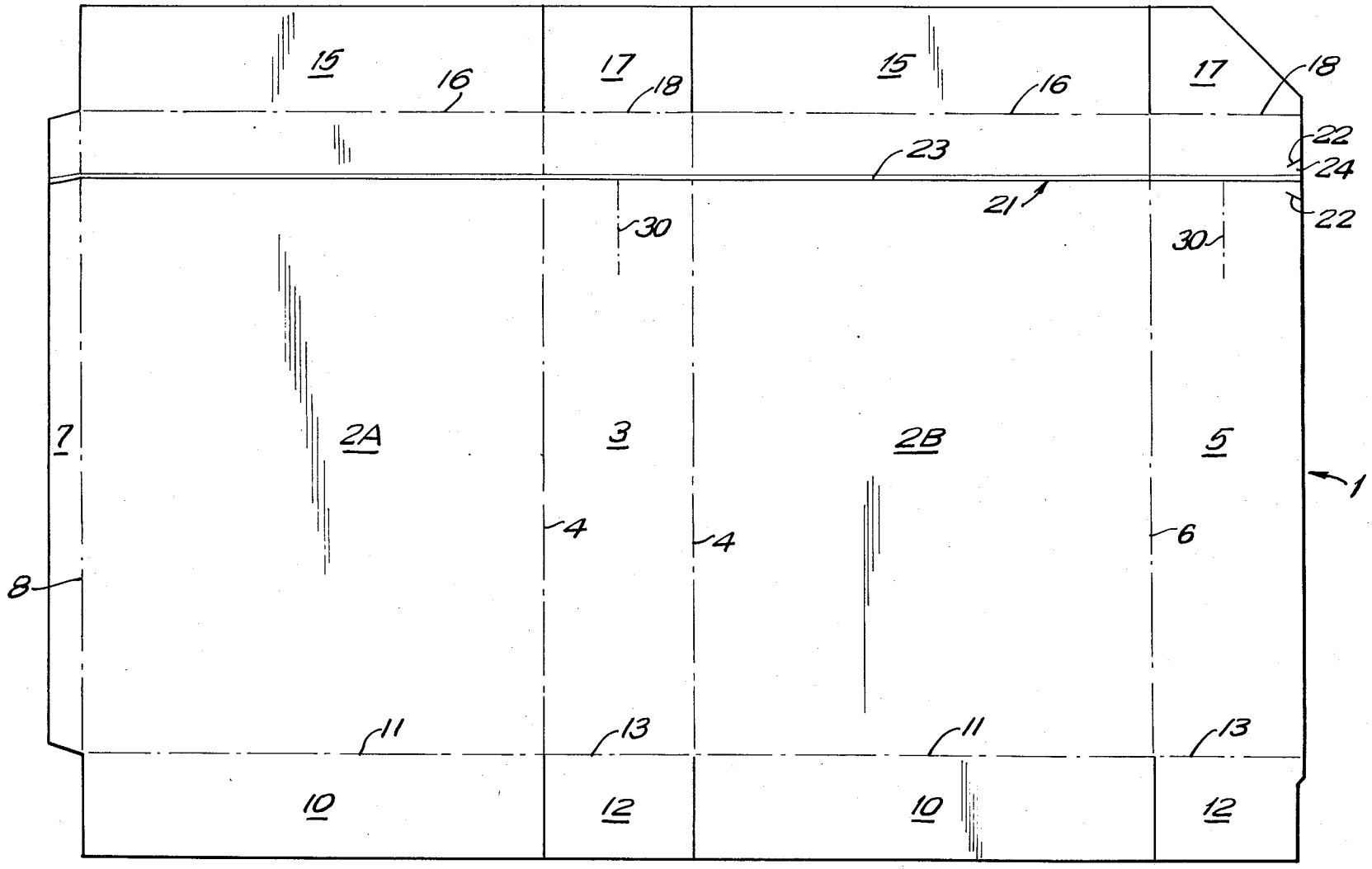
FIG. 1 is a plan view of a blank from which the carton of the present invention is formed.
Figure 2:
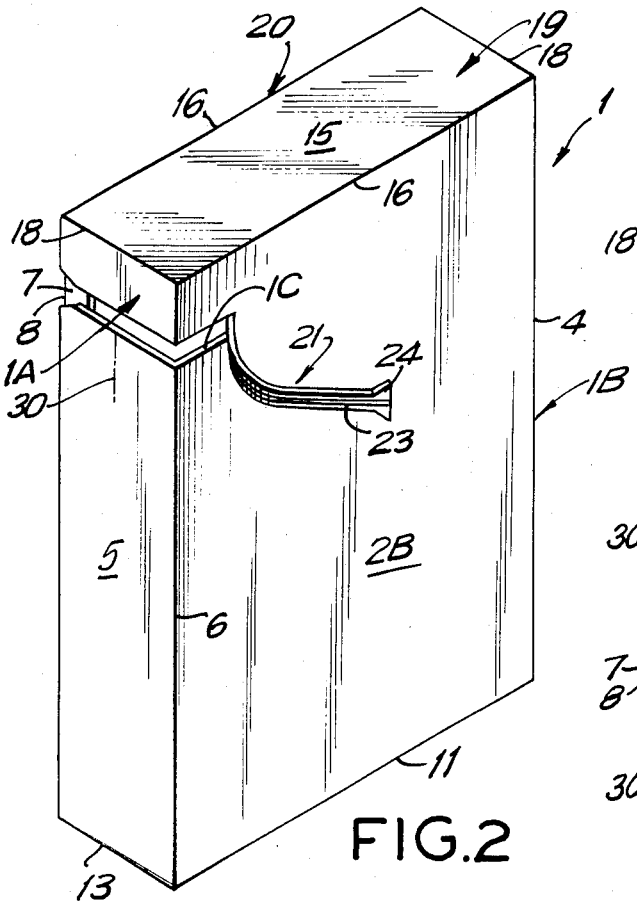
FIG. 2 is a perspective view showing a carton made from the blank of FIG. 1 and the manner of opening it.
Figure 3:
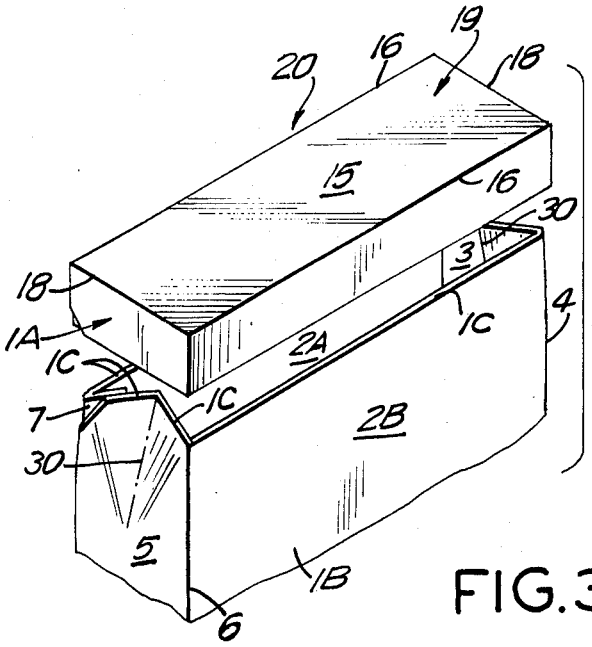
FIG. 3 is an exploded perspective view showing the closure cap in position to reclose the carton.

Referring to the drawings and more particularly to the embodiment shown in FIG. 1 to 3, the carton 1 of the present invention comprises a blank having a pair of side walls panels 2A and 2B and an inner end wall panel 3 foldably attached to the side wall panels 2A and 2B along fold lines 4. An outer end wall panel 5 is foldably attached to side wall panel 2B along a fold line 6 and a glue flap panel 7 is foldably attached to the side wall panel 2A along a fold line 8.

The side wall panels 2A and 2B are each provided with bottom wall panels 10 extending therefrom and foldable relative thereto along fold lines 11 and the end wall panels 3 and 5 are each provided with bottom flap panels 12 which are foldable relative to the end wall panels 3 and 5 along fold lines 13 coextensive with the fold lines 11. Top wall panels 15 extend from and are foldable relative to each side wall panel 2A and 2B along fold lines 16 and top flap panels 17 extend from and are foldable relative to each end wall panel 3 and 5 along fold lines 18 coextensive with fold lines 16.

To assemble the carton, the end and side wall panels 2A, 2B, 3 and 5 are folded along fold lines 4 and 6 with the glue panel 7 folded along fold line 8 and attached, by an adhesive or some other well known means, to the inner surface of the outer end panel 5 adjacent its outer edge. The bottom wall panels 10 and the bottom flap panels 12 are folded inwardly and adhered together in order to form the bottom wall assembly (not shown) and the top wall panels 15 and the top flap panels 17 are folded inwardly and adhered together to form the top wall assembly 19. The carton, as well as the method of forming it, which is described and shown herein, is a conventional carton. However, it will be understood that the particular structure of the carton may differ from the carton shown and described herein without departing from the invention.

A tear line assembly 21 parallel to and spaced below fold lines 16–18 extends across the entire blank 1, i.e. across side walls 2A–2B, end walls 3–5 and glue flap 7. The tear line assembly 21 is adapted to permit the carton 1 to be severed below the top wall assembly 19 when the carton is opened, as shown in FIG. 2, to separate the carton into an upper portion 20 (which constitutes a closure cap) and a lower portion 1B. Thus, severing the carton 1 along the tear line assembly 21 not only opens the carton, but also creates a closure cap 20 which is adapted to be reapplied over the lower portion 1B of the carton, to reclose the carton. The closure cap 20 comprises the top wall assembly 19 and a depending skirt portion 1A which is automatically formed when the upper portion 1A of the carton is separated from the lower portion 1B thereof.

The particular tear strip assembly 21 shown in the drawing comprises a thin tear string or wire 23 adhered to the inner surface of the carton with a pull tab 24 formed by slits 22 in the end panel 5. Tab 24 is adapted to be grasped by the user and pulled to cause the string 23 to cut the carton end walls 3–5, side walls 2A–2B and glue flap 7 and separate the upper portion 1A from the lower portion 1B (FIG. 2) to form the closure cap 20. However, it will be understood that the particular structure of the tear line assembly 21 may be changed without departing from the invention. For example, the string may be eliminated and a flat tear strip may be formed in the carton walls by a pair of closely adjacent parallel perforations.

In order to assist in reapplying the closure cap 20 to the lower portion 1B of the carton, squeeze lines 30 are provided in the end walls 3 and 5 which extend downwardly from the tear line assembly 21. The squeeze lines 30 permit the open mouth of the lower portion 1B to be squeezed together when the closure cap 20 is being reapplied so that the closure cap 20 may be easily mounted over the upper edges 1C of the open carton, as shown in FIG. 3. The squeeze lines 30 are preferably straight fold lines centrally located on both end walls 3 and 5. However, it will be understood that the squeeze lines 30 may be on one end wall only and may even be located on a side wall, without departing from the invention.

Figure 5:
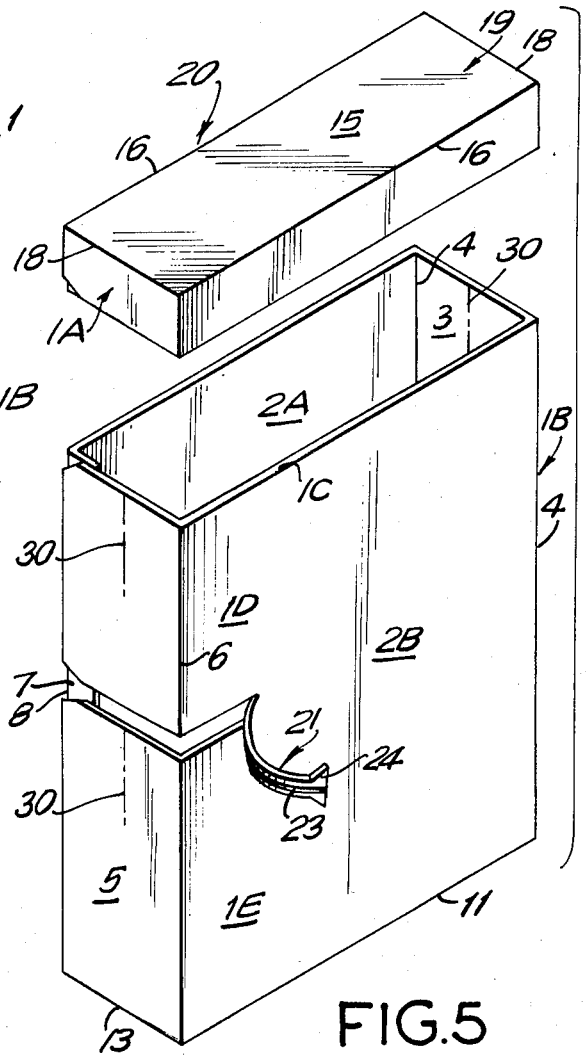
FIG. 5 is an exploded perspective view showing a carton made from the blank of FIG. 4.
Figure 4:
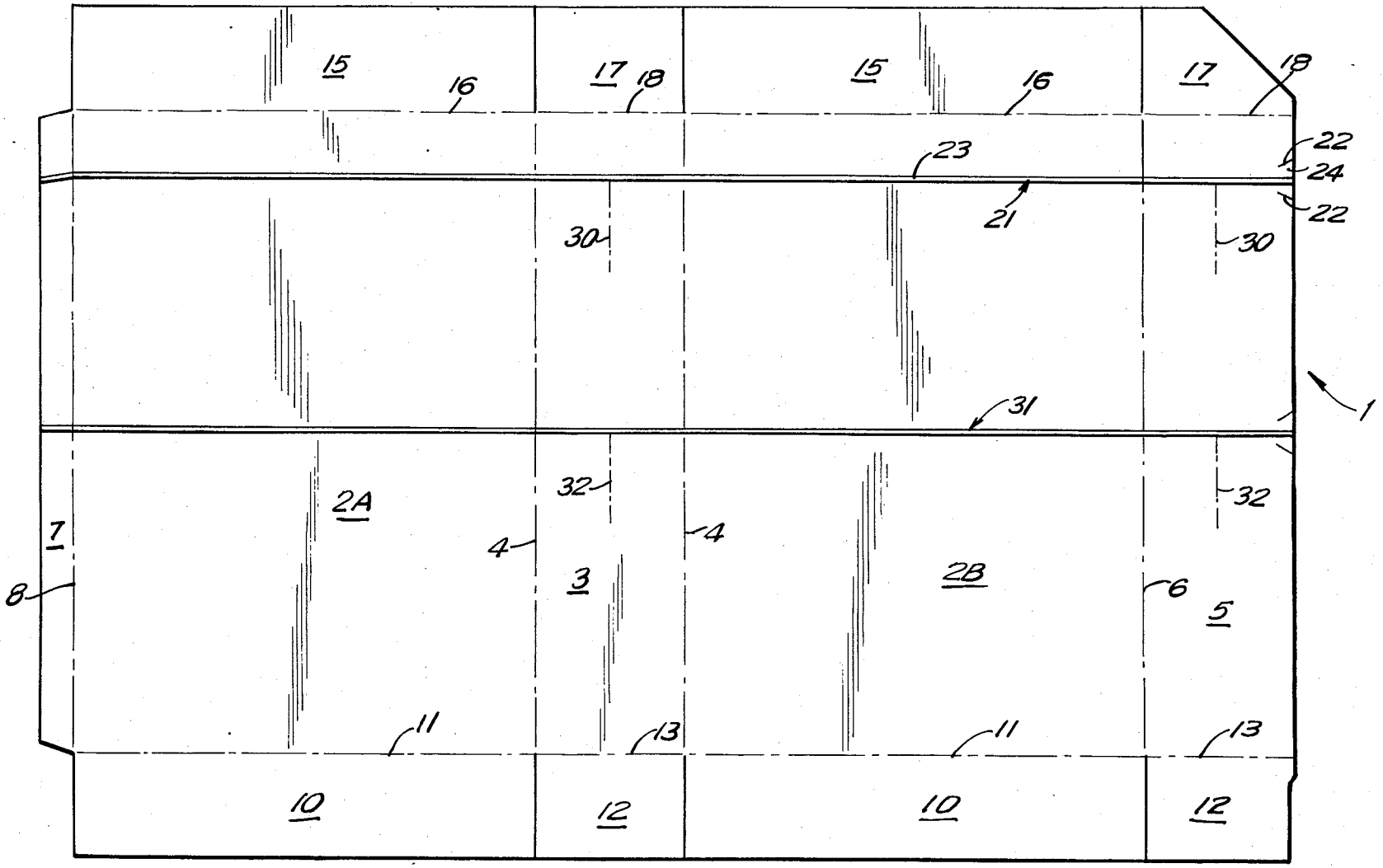
FIG. 4 is a plan view of a blank showing a modification of the present invention.

As shown in the embodiment of FIGS. 4 and 5, a second tear line assembly 31 with second squeeze lines 32 may be provided at a point on the carton spaced below the first tear line assembly 21 so that when the remaining contents in the carton are low, the upper section 1D of the carton 1 may be removed as shown in FIG. 5 and the closure cap 20 may then be reapplied to the remaining lower section 1E of the carton to form a smaller carton, thus saving storage space.

Figure 6:
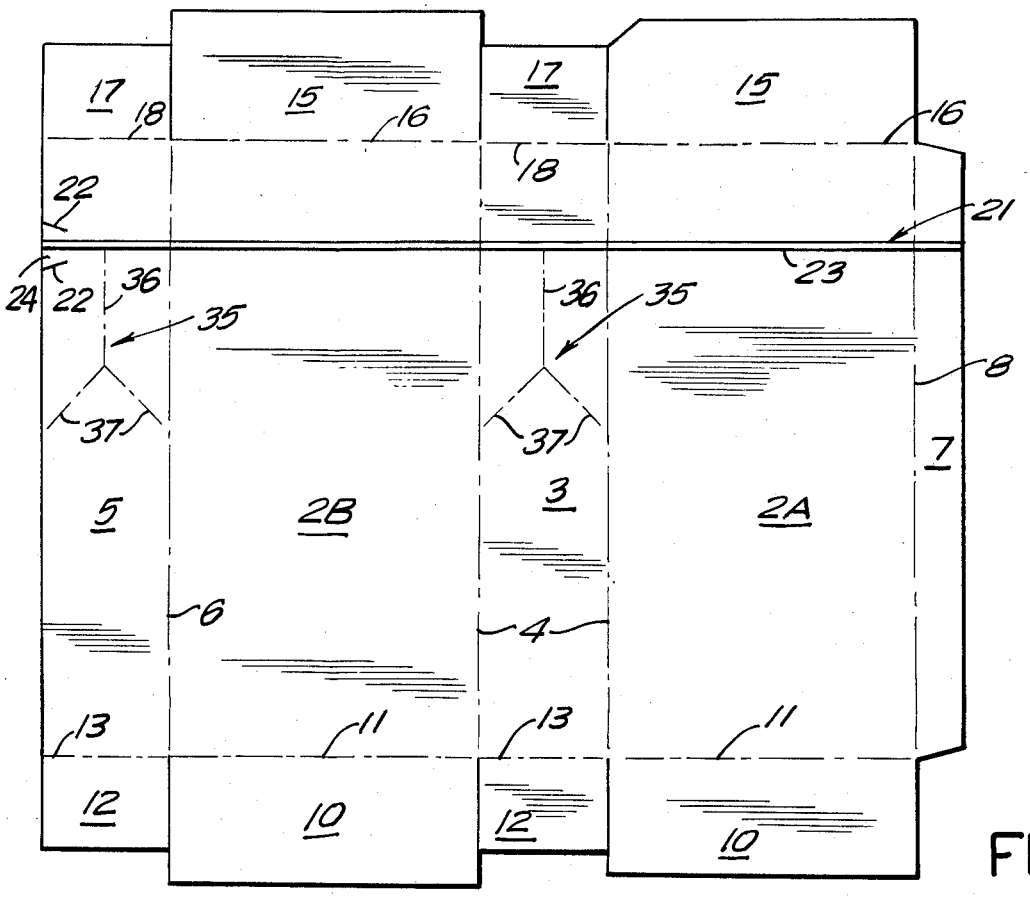
FIG. 6 is a plan view of a blank showing a modification of the present invention.
Figure 7:
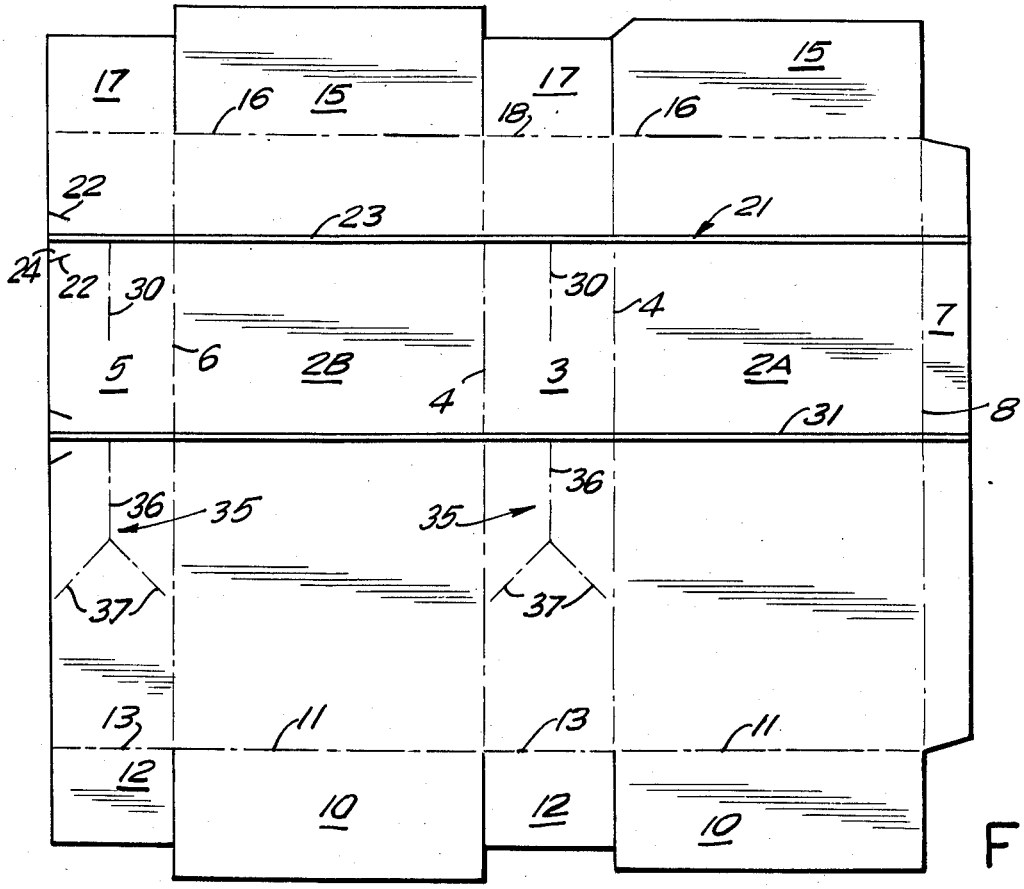
FIG. 7 is a plan view of a blank showing another modification of the present invention.

FIG. 6 of the drawing shows another embodiment of the invention in which the squeeze line assemblies 35 comprise a straight line 36 and diverging V-shaped extensions 37. In the embodiment of FIG. 6, a single set of squeeze lines 35 are shown. However, it will be understood that, if desired, when a carton has two tear lines, then two V-shaped squeeze lines 35 may be used. It will also be understood that a single carton may have both the squeeze lines 30 shown in FIG. 1, as well as the modified squeeze lines 35 shown in FIG. 5, without departing from the invention, as shown in the embodiment of FIG. 7.

When the carton 1 is to be opended, the user grasps the pull tab 24 and pulls on the tear string 23 to completely sever the top portion 1A of the carton 1 from the bottom 1B thereof in order to open the carton and form a closure cap assembly 20. After some of the contents of the carton 1 are removed, the area of the carton adjacent the upper edges 1C is squeezed along the squeeze lines 30 so that the closure cap 20 can be reapplied over the open end of the bottom portion 1B of the carton. The carton can be stored and the contents remaining in the carton are easily reuseable and readily accessible to the user by removing the closure cap 20. If the carton is provided with a second tear line assembly 31, the surplus upper section 1D of the carton may be removed by means of the second tear line assembly 31 to reduce the size of the remaining carton.

Figure 8:
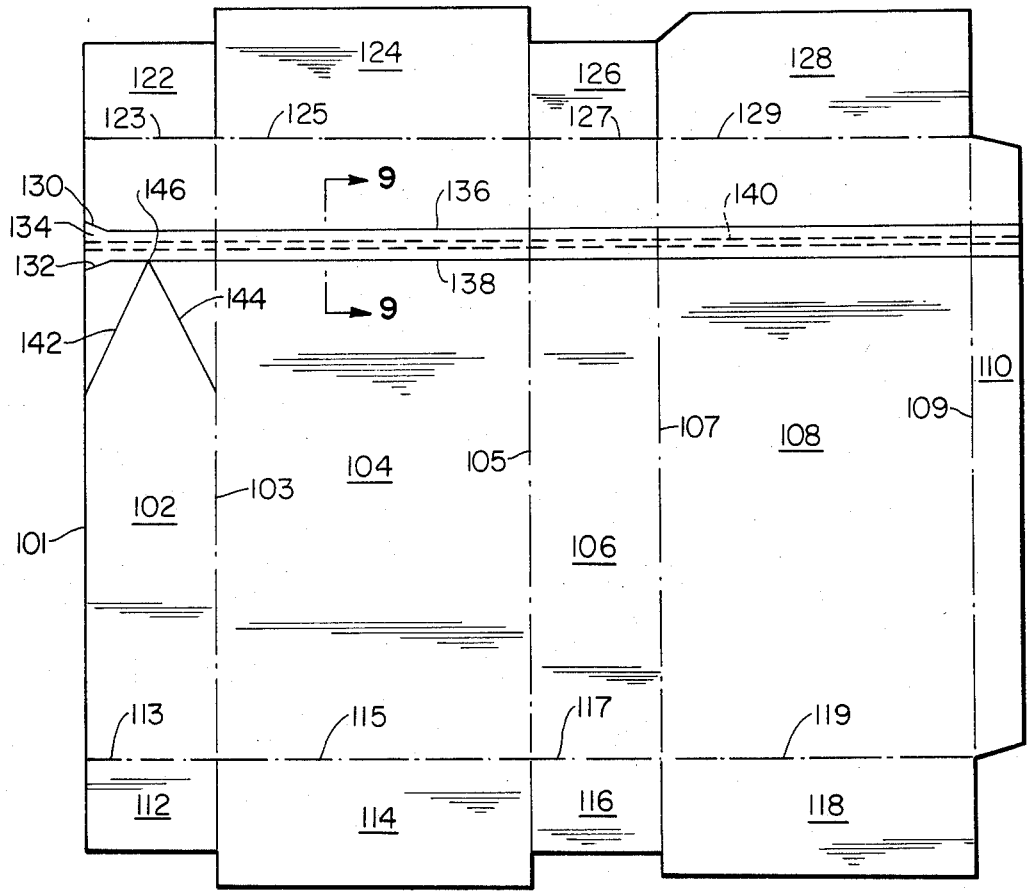
FIG. 8 is a plan view of a blank formed in accordance with another embodiment of the invention.

FIG. 8 shows a blank 100 formed in accordance with a particularly preferred embodiment of the subject invention. The blank 100 is similar to the blank shown in FIG. 6. Specifically, the blank 100 includes a first end panel 102, a first side panel 104, a second end panel 106, a second side panel 108 and a glue flap 110 which are consecutively articulated to one another along parallel fold lines 103, 105, 107 and 109 respectively.

Bottom end flap 112 is articulated to the first end panel 102 along fold line 113. Bottom side flap 114 is articulated to the first side panel 104 along fold 115. Similarly, bottom end flap 116 is articulated to the second end panel 106 along fold line 117, and bottom side flap 118 is articulated to the second side panel 108 along fold line 119. In a similar maner, top flaps 122, 124, 126 and 128 are articulated to the various end and side panels along fold lines 123, 125, 127 and 129 respectively as illustrated in FIG. 8.

The first end panel 102 further includes a pair of angularingly cut lines 130 and 132 which extend entirely through the paperboard material from which blank 100 is formed. The cut lines 130 and 132 are angled such that they are furthest apart adjacent edge 101 of first end panel 102. The cut lines 130 and 132 thus define a pull tab 134. The blank 100 further includes partial cut lines 136 and 138 which extend parallel to one another from the pull tab 134 entirely across the blank 100. As illustrated in both FIGS. 8 and 9 the partial cut lines 136 and 138 extend into the surface of blank 100 that will define the outside of the carton formed therefrom. More particularly, the partial cut lines 136 and 138 extend into blank 100 a distance "a" equal to between approximately 20% and 50% of the thickness "b" of blank 100. The cut lines 136 and 138 preferably are spaced from one another by approximately one-quarter inch as indicated by dimension "c" in FIG. 9.

Figure 9:
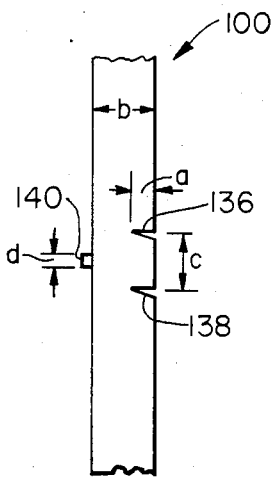
FIG. 9 is a cross sectional view taken along line 9—9 in FIG. 8.

A tear string 140 is adhered to the surface of blank 100 that will define the inwardly facing surface on the carton formed therefrom. The tear string 140 is disposed substantially centrally with respect to the partial cut lines 136 and 138. The width of the tear string 140, as indicated by dimension "d" in FIG. 9 is substantially less than the distance between the partial cut lines 136 and 138. In the preferred embodiment, the tear string 140 is approximately one-sixteenth inch wide as indicated dimension "d" in FIG. 9.

The blank 100 further includes score lines 142 and 144 which extend inwardly into the surface of blank 100 that will define the outer surface of the carton formed therefrom. More particularly, the score lines 142 and 144 are disposed entirely within the first end panel 102 and intersect one another at point 146 which lies on the partial cut line 138 and is substantially midway between edge 101 and fold line 103. The score lines 142 and 144 intersect one another at an angle of between 30° and 60°.

Figure 12:
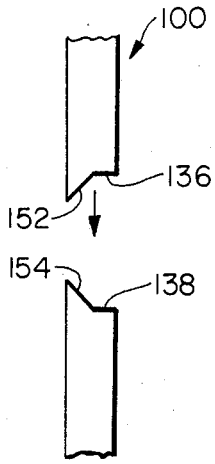
FIG. 12 is a cross sectional view taken along line 12—12 in FIG. 11.
Figure 10:
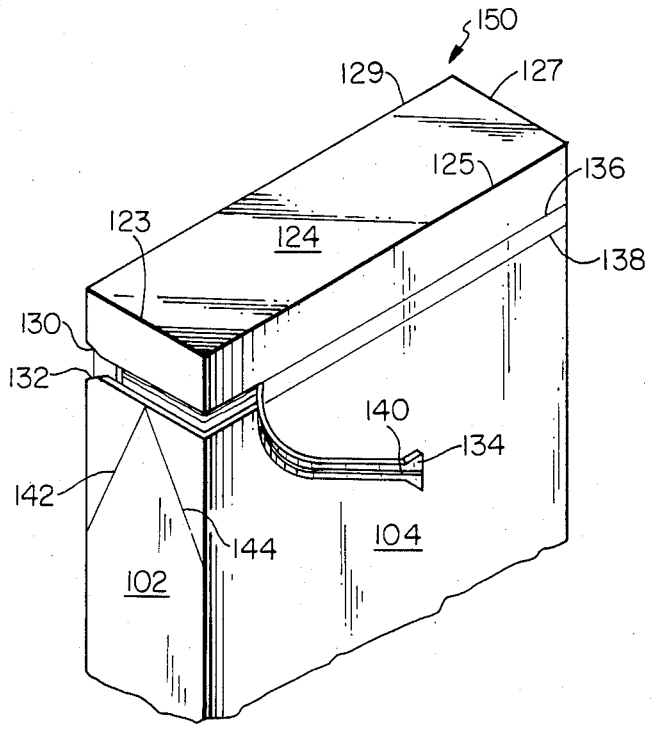
FIG. 10 is a perspective view of the carton formed from the blank in FIG. 8 during its initial opening.
Figure 11:
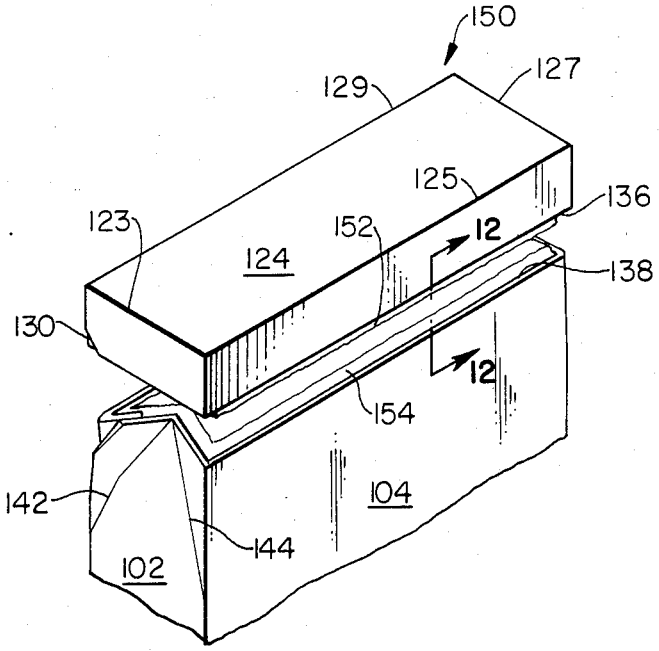
FIG. 11 is a perspective view of the carton formed from the blank in FIG. 8 after its initial opening.

The blank 100 is erected into a carton in substantially in the same manner as the blanks described in the other embodiments above. The resulting carton 150 is shown in FIG. 10. The carton 150 is opened by exerting a pulling force on the pull tab 134, as illustrated in FIG. 10. This pulling force on tab 134 causes the tear string 140 to be urged through the paperboard material from which the carton 150 is formed. This severance of the paperboard material is facilitated by the partial cut lines 136 and 138. The presence of the partial cut lines 136 and 138 results in a neat and aesthetically attractive severance of the paperboard material of carton 150. This severance is particularly neat adjacent the surface of the paperboard material that defines the outside of carton 150. However, as illustrated in FIG. 10 through 12, the severance is more jagged adjacent to the inner surface of the paperboard material from which carton 150 is formed. This jagged portion of the severance will lie at a point that had been immediately adjacent to the tear string 140. Since the tear string 140 had been considerably narrower than the distance between partial cut lines 136 and 138, the overall severance is tapered, as illustrated best by surfaces 152 and 154 in FIG. 12. The tapered surface 154 is particularly helpful in guiding the cap of the open carton 150 over the bottom. Furthermore, the tapered surface 152 is sufficiently flexible to be urged outwardly and into telescoping relationship over the base of the carton.

This reclosing of the carton is facilitated by the angle score lines 142 and 144. This simple arrangement of score lines merely requires the user to exert a pushing force on the first and second side panels 104 and 108 adjacent the first end panel 102. This results in the open portion of the base of the carton 150 becoming smaller to further facilitate the telescoping movement of the carton top over the base.

It will thus be seen that the present invention provides an improved carton which is easily recloseable and the top wall of which is not destroyed when the carton is opened and which has means for reducing the size of the carton.

As many and varied modifications of the subject matter of this invention will become apparent to those skilled in the art from the detailed description given hereinabove, it will be understood that the present invention is limited only as provided in the claims appended hereto.

What is claimed is:

1. A generally rectangular recloseable carton formed from a single blank of paperboard material, said carton comprising:

rectangular side walls disposed in spaced parallel relationship;

a pair of rectangular end walls foldably connected to and extending between the side walls of said carton;

opposed rectangular top and bottom walls extending between and foldably connected to the respective side and end walls; and a tear strip extending continuously around said carton generally parallel to the top and bottom walls thereof, said tear strip comprising a pair of spaced apart parallel partial cut lines extending into the outer surface of said carton a distance equal to between approximately 20 percent and 50 percent of the thickness of the paperboard material from which the carton is formed, said tear strip further comprising a tear string adhered to the inner surface of the carton at a location thereon generally centrally between the partial cut lines, said tear string having a thickness substantially less than the distance between the partial cut lines, whereby a pulling force exerted on said tear strip causes a tapered severance in the paperboard material from which the carton is formed.

2. A carton as in claim 1 wherein the partial cut lines are spaced apart approximately one-quarter inch.

3. A carton as in claim 2 wherein the thickness of the tear string is approximately one-sixteenth inch.

4. A carton as in claim 1 further comprising a pair of score lines extending inwardly into the outer surface of the carton in one of said end panels thereof, said score lines intersecting one another at the partial cut line closest to the bottom of the carton and extending therefrom to the respective end panel edges where the associated end panel and the side panels attached thereto meet.

5. A carton as in claim 4 wherein the score lines in said end panels intersect one another at a location centrally disposed between the side panels of the carton.

6. A carton as claim 5 wherein the score lines intersect one another at approximately 30°.

7. A blank for forming a paperboard carton, said blank comprising rectangular first end panel, rectangular first side panel, rectangular second end panel, rectangular second side panel and glue flap consecutively articulated to one another along parallel fold lines, top and bottom flaps articulated respectively to each of said first end panel, first side panel, second end panel and second side panel, said blank further including a tear strip extending entirely across said blank generally perpendicular to the articulations between said side and end panels, said tear strip being defined by a pair of spaced apart partial cut lines extending into said blank a distance of between 20 percent and 50 percent of the thickness of said blank, said tear strip further comprising a tear string adhered to the surface of said blank opposite the partial cut lines and disposed generally centrally between said partial cut lines.

8. A blank as in claim 7 wherein said partial cut lines are spaced from one another by approximately one-quarter inch.

9. A blank as in claim 8 wherein the tear string is approximately one-sixteenth of an inch wide.

10. A blank as in claim 7 wherein the first end panel further comprises a pair of score lines extending into the surface of said blank into which said partial cut lines are are formed, said score lines intersecting one another at the partial cut line nearest the bottom flaps of said blank and extending away from one another and generally toward the bottom flaps of said blank.

11. A blank as in claim 10 wherein the score lines are angularly separated from one another by approximately 30°.

* * * * *